US009038539B2

(12) United States Patent
Piehler et al.

(10) Patent No.: US 9,038,539 B2
(45) Date of Patent: May 26, 2015

(54) WARHEAD CASE AND METHOD FOR MAKING SAME

(71) Applicant: U.S. Army Research Laboratory ATTN: RDRL-LOC-I, Adelphi, MD (US)

(72) Inventors: Thuvan N. Piehler, Fallston, MD (US); Rohan J. Banton, Bel Air, MD (US); Christopher S. Meyer, North East, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 13/917,847

(22) Filed: Jun. 14, 2013

(65) Prior Publication Data

US 2014/0366764 A1 Dec. 18, 2014

(51) Int. Cl.

| | |
|---|---|
| ***F42B 12/02*** | (2006.01) |
| ***F42B 12/22*** | (2006.01) |
| ***F42B 12/24*** | (2006.01) |
| ***F42B 12/26*** | (2006.01) |
| ***F42B 33/00*** | (2006.01) |
| ***F42B 30/08*** | (2006.01) |
| ***F42B 12/10*** | (2006.01) |

(52) U.S. Cl.

CPC ..... *F42B 12/10* (2013.01); *F42B 33/00* (2013.01); *F42B 12/26* (2013.01); *F42B 12/22* (2013.01); *F42B 12/02* (2013.01); *F42B 30/08* (2013.01); *F42B 12/24* (2013.01)

(58) Field of Classification Search

CPC ..... F42B 12/00; F42B 12/02; F42B 12/10; F42B 12/20; F42B 12/22; F42B 12/24; F42B 12/26; F42B 30/08; F42B 33/00; F42B 33/001

USPC ..... 102/473, 474, 475, 491, 492, 493, 494, 102/495, 496; 86/51, 53

See application file for complete search history.

(56) References Cited

U.S. PATENT DOCUMENTS

| | | | | | |
|---|---|---|---|---|---|
| 2,977,885 | A | * | 4/1961 | Perry, Jr. et al. | 102/285 |
| 3,750,587 | A | * | 8/1973 | Walde | 102/496 |
| 4,057,001 | A | * | 11/1977 | Valentine | 86/1.1 |
| 4,398,467 | A | * | 8/1983 | Leigh | 102/491 |
| H238 | H | * | 3/1987 | Adams | 102/493 |
| 6,038,979 | A | * | 3/2000 | Watson et al. | 102/481 |
| 6,857,372 | B2 | * | 2/2005 | Renaud-Bezot et al. | 102/493 |

FOREIGN PATENT DOCUMENTS

EP 0297206 A1 * 1/1989

* cited by examiner

*Primary Examiner* — James S Bergin
(74) *Attorney, Agent, or Firm* — Robert Thompson

(57) ABSTRACT

A case for a warhead having a plurality of elongated wires which are braided or woven together to form a mesh which is formed into the shape corresponding to the warhead case. The mesh is impregnated with a polymer matrix which, upon curing, forms a rigid warhead case. At least some of the elongated wires include notches at selected locations which form fracture points which shape a blast from a subsequent explosion of the warhead.

11 Claims, 2 Drawing Sheets

WARHEAD CASE AND METHOD FOR MAKING SAME

GOVERNMENT INTEREST

The invention described herein may be manufactured, used, and licensed by or for the United States Government.

BACKGROUND OF THE INVENTION

I. Field of the Invention

The present invention relates generally to munitions and, more particularly, to a warhead case and method for making the same.

II. Description of Related Art

Artillery, such as tanks, cannons, and the like, typically fire a warhead through a barrel and towards a target by using an explosive charge in the barrel. The artillery warhead is generally cylindrical in shape having a smaller diameter tapered nose at its front end.

The warhead itself includes an outer shell case which defines the overall outer shape of the warhead. The case, however, forms a hollow interior which is at least partially filled with an explosive charge. Upon impact of the warhead against the target with sufficient velocity, the shockwaves created by the impact of the warhead on the target are sufficient to detonate its explosive charge. Alternatively, a fusing mechanism may be used to initiate the detonation chain.

The previously known warhead cases have been typically constructed of a metal, such as steel, which is sufficiently thin that the case will fragment into shrapnel upon impact and detonation with its target. These previously known cases for warheads, however, have all suffered some common disadvantages.

For example, in many situations, such as where the warhead is used in an urban environment, it is highly desirable that the explosive blast upon detonation of the warhead is directed forwardly of the warhead rather than laterally. Such forward concentration of the force not only maximizes damage to the target, but also limits collateral damage that could otherwise result from lateral shrapnel.

The previously known warhead cases constructed of metal, such as steel, fail to adequately shape or direct the force of the warhead upon detonation in the forward direction. As such, when the warhead case breaks into many parts upon detonation of the warhead, shrapnel from the fractured warhead case extends not only forwardly, but also laterally, of the warhead.

A still further disadvantage of these previously known warhead cases is that such warhead cases fail to meet the insensitive munitions requirements because such warheads lack venting capability. Although there have been prior attempts to vent the warhead to prevent detonation of the warhead in the event of an unintended puncture of the warhead through scoring, liners, and venting mechanisms, these attempts have not proven wholly satisfactory. Furthermore, unless properly vented, upon unintended puncture, e.g. impact from shrapnel or other projectile, the resulting heat and pressure buildup within the interior of the warhead case may be sufficient to detonate the warhead.

SUMMARY OF THE PRESENT INVENTION

The present invention provides a warhead case which overcomes the above mentioned disadvantages of the previously known warhead cases.

In brief, the warhead case of the present invention is constructed by braiding a plurality of elongated wires together into a mesh. The mesh itself is in the shape corresponding to the shape of the warhead case.

After forming the mesh into the shape of the warhead case, the mesh is then impregnated with a polymer matrix which, upon curing preferably through a thermal curing process, forms a rigid warhead case with a hollow interior. The hollow interior is at least partially filled with an explosive charge in the conventional fashion.

Alternatively, the mesh is first impregnated with a polymer matrix and then formed into the shape of the warhead case using any conventional shaping process, such as a die and press. Furthermore, any conventional polymer may be used provided that the strength of the warhead case, i.e. the polymer impregnated mesh after curing, is sufficient to survive launch of the warhead.

The wires also include a plurality of notches at predetermined locations. Each notch is preferably formed by punching the wire with a chisel which embrittles the wire in the area around the notch. Consequently, upon detonation of the warhead, the wires will break into segments in the area around the notches. This achieves two important advantages.

First, by varying the density of the notches in the mesh depending upon the location along the length of the warhead, the notches can shape the direction of the blast caused by detonation of the warhead. For example, by providing a high density of notches along the front or nose of the warhead and a lesser density of notches along the base and mid portion of the warhead, the higher density of notches in the nose area of the warhead will fracture first causing the blast to be concentrated in the forward direction of the warhead.

Secondly, the notches define the shape and size of the shrapnel caused upon detonation of the warhead.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figures 1, 2:
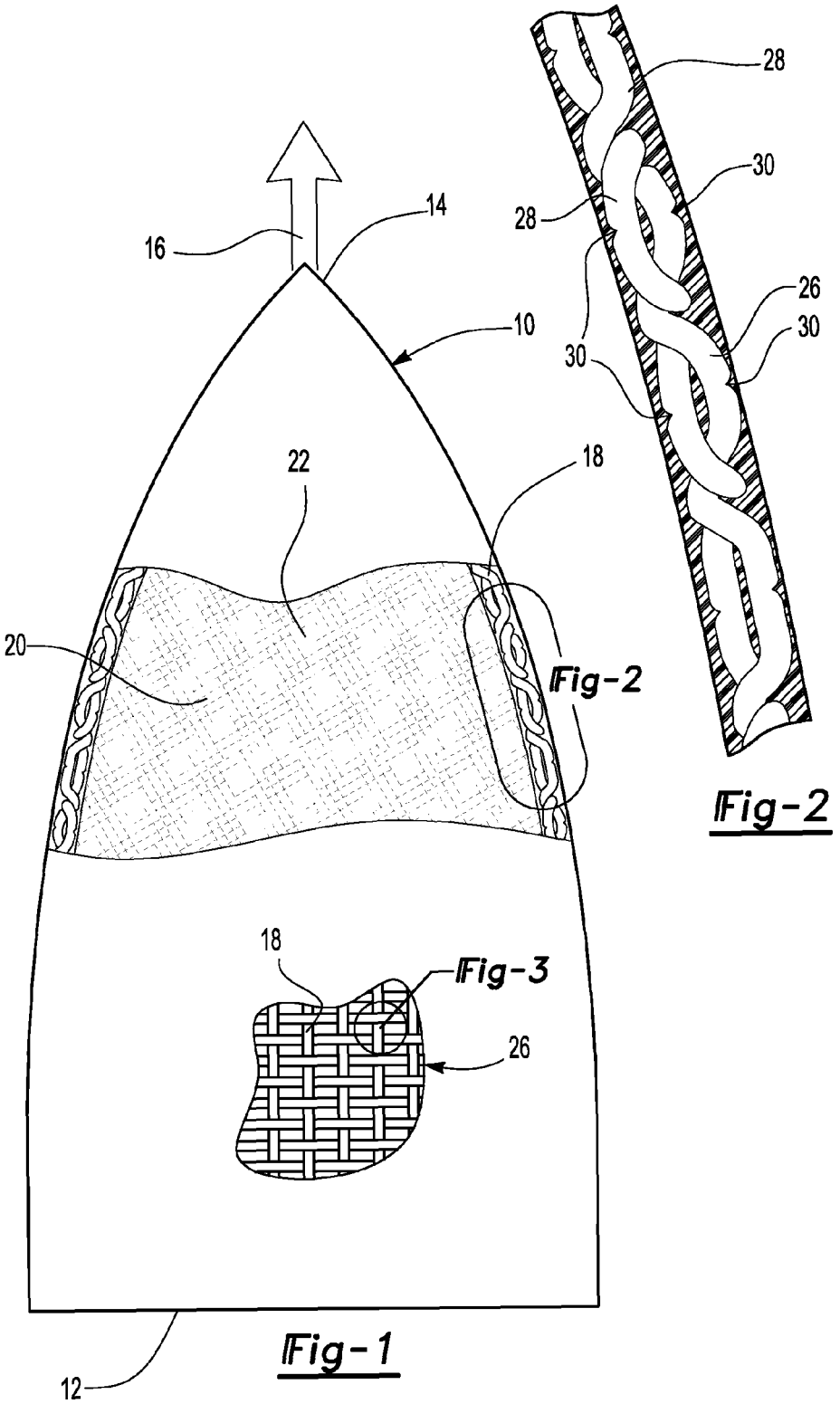
FIG. 1 is an elevational view illustrating a warhead shell according to the present invention.
FIG. 2 is a view taken along circle 2-2 in FIG. 1 and enlarged for clarity.

With reference first to FIG. 1, a warhead 10 according to the present invention is illustrated and is either of the type shot by artillery, such as cannons, tanks, and the like, or the type propelled by rocket motors. The warhead 10 itself is generally cylindrical in shape at its base 12 and tapers to a reduced diameter nose 14 at its forward end. When fired by an explosive charge through a barrel, the warhead 10 travels, at least initially, in the direction of arrow 16. Still referring to FIG. 1, the warhead 10 includes an outer warhead case 18 which forms the outer surface of the warhead 10 and thus the overall shape of the warhead 10. The warhead case 18, however, includes an open interior 20 which is at least partially filled by an explosive charge 22. Upon impact of the warhead 10 at sufficient velocity, the shockwaves caused by the impact of the warhead 10 against the target detonates the explosive charge 22 in the well-known fashion, or the warhead is detonated by a fusing mechanism.

Figure 3:
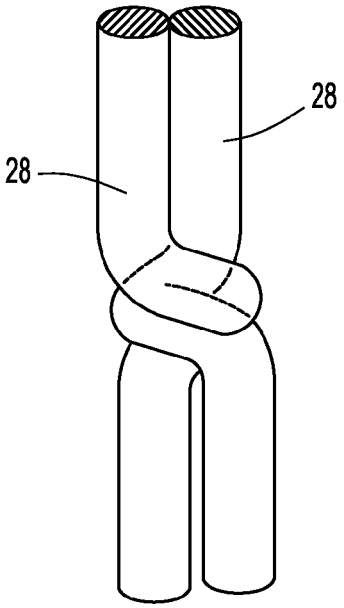
FIG. 3 is a view illustrating a short segment of the wire mesh.

With reference now to FIGS. 2 and 3, unlike the previously known warhead cases, the warhead case 18 of the present invention is constructed from a wire mesh 26 constructed by braiding a plurality of wires 28 woven and/or braided together to form the mesh. Preferably, the wires 28 do not extend the entire distance from the nose 14 of the warhead and to its base 12. Instead, a plurality of shorter wire segments are braided or woven together to form the mesh with the number of wires 28 decreasing from the base 12 to the nose 14 to accommodate the decreasing outer circumference of the case 18. FIG. 3 illustrates how two wires 28 may be woven or braided together to form the mesh.

The wire mesh 26 may be formed into the shape of the warhead case 18 in any conventional manner. For example, the wire mesh 26 may be woven into the shape of the warhead case 18. Alternatively, the wire mesh 26 may be woven into a flat or semi flat sheet and then formed into the shape of the warhead case 18 using conventional shaping methods, such as a punch and die. Other shaping methods may also be used.

The wire, for example wire 28, which form the mesh 26 may be constructed of any strong, dense material. However, preferably the wires forming the mesh 26 are constructed of metal, such as steel.

Figure 4:
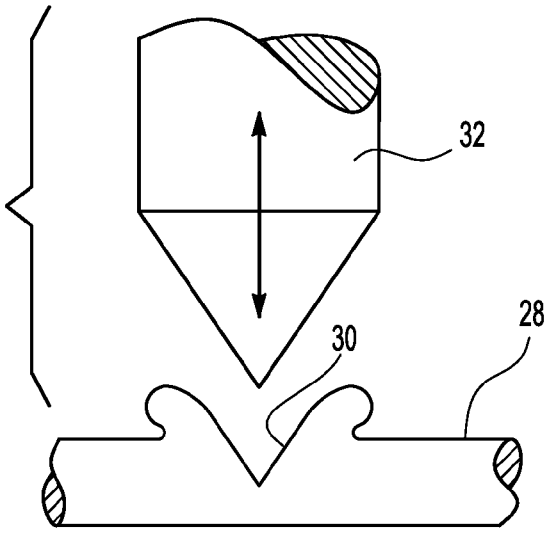
FIG. 4 is a fragmentary view illustrating the formation of the notches in the wire.

With reference now to FIGS. 2 and 4, many, if not all, of the wires 28, which form the mesh 26 contain notches 30 at spaced intervals along their length. These notches are preferably formed by impacting a punch 32 against the wire 28 to form the notch in the desired location. The use of a punch 32 work hardens the metal wire 28 around the notch 30 which makes the material of the wire 28 around the notch 30 more brittle as well as reducing the cross-sectional area of the wire 28 at the notch 30. Both the reduction in the cross-sectional area, as well as an increase in the brittleness of the wire 28 around the notch 30 increases the likelihood that, upon detonation of the warhead 10, the wire 28 will fracture at or near the notch 30 rather than at random spots along the length of the wire 28.

Other methods may alternatively be used to control the fracture location for the wires 28 upon detonation. For example, the wires 28 may be scored or punched around a portion or all of the circumference of the wire 28 to create a fracture location.

The ability to set and control the point of fracture of the wires forming the mesh 26 forms two important functions. First, by varying the density of the notches 30 in the mesh 28, the shape or direction of blast of the warhead 10 upon detonation may be controlled. For example, increasing the density of the notches 30 in the mesh 26 around the nose 14 of the warhead 10 as compared with the density of the notches 30 around the base 12 of the warhead 10, causes the warhead case 18 to fracture more readily at its nose 14 than its base 12 upon impact. Consequently, the force occurring from the resulting detonation is directed largely in a forward direction, i.e. in the direction of arrow 16. Secondly, by controlling the positions of the notches 30 in the wires 28, the size of shrapnel created during the detonation from the wire pieces may be controlled so that different shrapnel sizes may be used for different applications.

With reference particularly to FIG. 3, preferably adjacent wires 28 in the mesh 26 are braided together so that the wires 28 are entwined but still extend in a generally axial direction, i.e. the direction of arrow 16. Such a construction improves the aerodynamic characteristics of the warhead 10 and reduces possible tumbling.

After the mesh 26 has been shaped into the shape of the warhead case 18 with the density of the notches arranged as desired, the entire mesh 26 is impregnated with a polymer matrix. Once set, the polymer matrix together with the mesh 26 form the rigid structure for the warhead case 18 and are together sufficiently stiff and strong to sustain the forces the warhead 10 is subjected to during launch.

Although the mesh 26 is preferably first formed into the shape of the warhead case 18 and then impregnated with the polymer matrix, alternatively the mesh is first impregnated with the polymer matrix and then formed into the shape of the warhead case 18.

Figure 5:
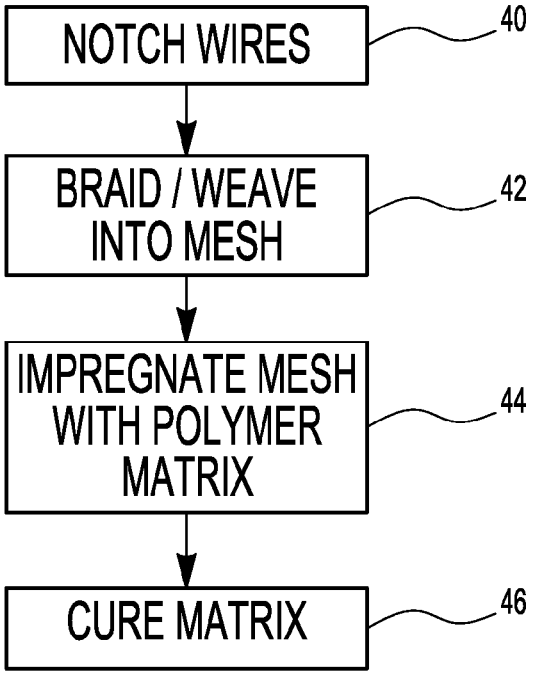
FIG. 5 is a flow diagram illustrating the method of manufacturing the warhead case of the present invention.

With reference now to FIG. 5, a flowchart illustrating the manufacture of the warhead case 18 is shown. At step 40 the wires 28 which ultimately will form the mesh 26 for the warhead case 18 are notched preferably by using the punch shown in FIG. 4. As previously described, the spacing between the notches 30 along the various wire segments that ultimately form the warhead case 18 will vary depending upon the location of the wire segment in the warhead case 18. Step 40 then proceeds to step 42.

At step 42, the notched wires 28 are then braided or woven into a mesh having the overall shape of the warhead case 18. As previously described the mesh 26 may be woven or braided into the shape of the warhead case 18 or, alternatively, pressed into the shape of the warhead case 18 using a punch and die or other means. Any conventional means may be used to perform this weaving and forming operation. Step 42 then proceeds to step 44.

At step 44, the mesh is impregnated with a polymer matrix. Any common polymer matrix may be utilized.

At step 46, the polymer matrix is then cured, if required, preferably by heating and cooling the impregnated mesh, so that upon cooling, the matrix hardens and forms the rigid outer case 18 for the warhead 10. The warhead case 18 is then filled with the explosive charge and detonation components in the conventional manner, thus completing the warhead 10.

In the event that the warhead 10 is punctured by a projectile of some sort, such as a bullet, the shockwaves or frictional heating resulting from the impact of the projectile will cause the explosive material 22 of the warhead 10 to heat to a temperature less than the detonation temperature of the warhead 10, or in the event that the warhead is within or near some heat source such as a burning vehicle. This heating, the rate of which is known as a "fast or slow cook off", will soften the thermoplastic polymer matrix and allow the pressures resulting from the heating of the explosive material 22 to create openings in the polymer matrix so that the pressure can vent through the openings in the polymer matrix. In doing so, such venting is not only automatic, but effectively prevents any possible detonation of the warhead 10 caused by these stimuli.

From the foregoing, it can be seen that the present invention provides a novel warhead case in which the explosive force resulting from detonation of the warhead may be shaped or directed in a desired direction, typically forwardly of path of travel of the warhead. Additionally, the present invention provides for automatic venting of pressure buildups that may be caused by impact of a projectile or other stimulus sufficient to create heating and thus pressure buildup of the warhead explosive material 22, but short of detonation. A still further advantage of the present invention is that the size of shrapnel created by detonation of the warhead may be adjusted for different situations by simply varying the spacing of the notches in the mesh forming the warhead case.

Having described our invention, many modifications will become apparent to those skilled in the art to which it pertains without deviation from the spirit of the invention as defined by the scope of the appended claims.

We claim:

1. A case for a warhead comprising:

a plurality of elongated wires, said wires being braided together to form a mesh having a shape corresponding to the warhead case, said mesh impregnated with a polymer matrix, which forms the warhead case, wherein at least some of said elongated wires include notches at selective locations which form fracture points which shape a blast from a subsequent explosion of the warhead.

2. The case as defined in claim 1 wherein said wires are constructed of a metal.

3. The case as defined in claim 2 wherein said metal comprises steel.

4. The case as defined in claim 1 wherein said case has a front and a base and wherein said wires extend generally longitudinally between the front and the base of the case.

5. The case as defined in claim 4 wherein the spacing between said notches on said wires decreases from the base and the front of the case.

6. The case as defined in claim 1 wherein a density of notches adjacent a front of the case is greater than the density of notches adjacent a base of the case.

7. A method of constructing a case for a warhead comprising the steps of:

forming a plurality of notches in a plurality of wires, braiding a mesh from said plurality of wires, shaping said mesh into a shape of a warhead having a front and a base, impregnating said mesh with a polymer matrix, and curing said polymer matrix, wherein said wires have a plurality of notches at selective locations which form fracture points which shape a blast from a subsequent explosion of the warhead.

8. The method as defined in claim 7 wherein said forming step comprises the step of arranging said wires so that said wires extend generally longitudinally between the front and the base of the case.

9. The method as defined in claim 8 wherein said wires are made of metal.

10. The method as defined in claim 7 wherein said braiding step comprises the step of wrapping adjacent wires together.

11. The method as defined in claim 7 wherein said forming step further comprises the step of punching said wires with a chisel.

* * * * *